US012024801B2

(12) United States Patent
Lonati et al.

(10) Patent No.: US 12,024,801 B2
(45) Date of Patent: Jul. 2, 2024

(54) UPPER AND METHOD FOR THE MANUFACTURE OF AN UPPER

(71) Applicant: LONATI S.P.A., Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 348 days.

(21) Appl. No.: 17/434,905

(22) PCT Filed: May 7, 2020

(86) PCT No.: PCT/EP2020/062769
§ 371 (c)(1),
(2) Date: Aug. 30, 2021

(87) PCT Pub. No.: WO2020/244884
PCT Pub. Date: Dec. 10, 2020

(65) Prior Publication Data

US 2022/0142289 A1 May 12, 2022

(30) Foreign Application Priority Data

Jun. 3, 2019 (IT) ..... 102019000007821

(51) Int. Cl.
*D04B 1/10* (2006.01)
*A43B 1/04* (2022.01)
(Continued)

(52) U.S. Cl.
CPC ..... *D04B 1/102* (2013.01); *A43B 1/04* (2013.01); *A43B 23/0265* (2013.01);
(Continued)

(58) Field of Classification Search
CPC ..... D04B 1/123; D04B 15/56; D04B 1/13; D04B 1/102; A43B 1/04; A43B 23/0265;
(Continued)

(56) References Cited

U.S. PATENT DOCUMENTS 5,429,555 A 7/1995 Beckh
5,615,562 A * 4/1997 Roell ..... D04B 1/22 66/84 R
(Continued)

FOREIGN PATENT DOCUMENTS

CN 1681984 A 10/2005
CN 104246040 A 12/2014
(Continued)

OTHER PUBLICATIONS

Office Action issued for Korean Patent Application No. 10-2021-7024836, Dated Jun. 20, 2023, 5 pages.
(Continued)

*Primary Examiner* — Danny Worrell
(74) *Attorney, Agent, or Firm* — Quicker Law, LLC

(57) ABSTRACT

A semi-finished component for the manufacture of knitted uppers, comprising a plain knitting and a purl knitting, and at least one longitudinally extended channel which is formed within the knitting between the plane formed by the plain knitting and the plane formed by the purl knitting, the at least one longitudinally extended channel being engageable by an elongated engagement element which forms a lace or a reinforcement element designed to engage with a lace.

10 Claims, 4 Drawing Sheets

(51) Int. Cl.

| | |
|---|---|
| ***A43B 23/02*** | (2006.01) |
| ***D04B 1/12*** | (2006.01) |
| ***D04B 1/24*** | (2006.01) |

(52) U.S. Cl.
CPC ..... *D04B 1/123* (2013.01); *D04B 1/24* (2013.01); *D10B 2501/043* (2013.01)

(58) Field of Classification Search
CPC .... D10B 2403/02411; D10B 2403/032; D10B 2501/043
See application file for complete search history.

(56) References Cited

U.S. PATENT DOCUMENTS

| | | | | |
|---|---|---|---|---|
| 9,404,205 | B2 | 8/2016 | Meir | |
| 10,753,018 | B2 * | 8/2020 | Kuo | D04B 15/90 |
| 11,408,105 | B2 * | 8/2022 | Dealey | D04B 15/48 |
| 11,414,796 | B2 * | 8/2022 | Meir | D04B 1/123 |
| 2005/0122206 | A1 * | 6/2005 | Reichel | D04B 1/14 338/208 |
| 2006/0207296 | A1 | 9/2006 | Fujikawa | |
| 2014/0237861 | A1 | 8/2014 | Podhajny | |
| 2017/0215515 | A1 | 8/2017 | Meir | |
| 2018/0235318 | A1 | 8/2018 | Terai et al. | |

FOREIGN PATENT DOCUMENTS

| | | | |
|---|---|---|---|
| CN | 104452071 | A | 3/2015 |
| CN | 105164327 | A | 12/2015 |
| CN | 105188442 | A | 12/2015 |
| CN | 106174877 | A | 12/2016 |
| CN | 107920629 | A | 4/2018 |
| CN | 108779591 | A | 11/2018 |
| EP | 2982786 | A1 | 2/2016 |
| JP | 3928178 | B2 | 6/2007 |
| JP | 2016-198481 | A | 12/2016 |
| JP | 2017-124228 | A | 7/2017 |
| KR | 20160058848 | A | 5/2016 |
| KR | 20170065619 | A | 6/2017 |
| WO | 2014/096561 | A1 | 6/2014 |
| WO | 2015/068108 | A1 | 5/2015 |

OTHER PUBLICATIONS

Office Action issued for Colombian Patent Application No. NC2021/0010126, Dated Apr. 26, 2023, 5 pages.
Office Action issued by the Chinese Patent Office for Chinese Patent Application No. 202080011822.3 dated Jun. 1, 2022, 15 pages.
Office Action for Algerian Patent Application No. 210811 issued Jul. 13, 2022, 1 page.
Office Action for Eurasia Patent Application No. 202191887 issued Jul. 25, 2022, 5 pages.
European Examination Report issued for European Application No. EP 20729950.4, dated Sep. 19, 2022 (8 pages).
Examination Report issued for India Patent Application No. 202137039751 issued Mar. 13, 2022, 7 pages.
Egyptian examination report issued for Application No. EG 202111830, dated Jul. 24, 2023 (8 pages).
Office Action issued for Chinese Application No. CN 202080011822.3, dated Jan. 28, 2023 (12 pages).
Office Action issued for Eurasia Application No. EA 202191887, dated Dec. 23, 2022 (4 pages).
Search Report issued for Italian Application No. IT2019000007821 dated Feb. 5, 2020, 10 pages.
International Search Report and Written Opinion for International Application No. PCT/EP2020/062769 dated Aug. 25, 2020, 12 pages.
European examination report issued for Application No. EP 20729950.4, dated Feb. 28, 2023 (8 pages).
Office Action mailed Dec. 5, 2023 in Japanese Application No. 2021-564835 with English-language translation (10 pgs.).

* cited by examiner

UPPER AND METHOD FOR THE MANUFACTURE OF AN UPPER

The present invention relates to an upper and to a method for the manufacture of an upper.

Shoes, especially sports shoes, in which the upper is provided by knitting, are known commercially.

It has in fact been observed that by providing the upper by knitting it is possible to manufacture shoes with rather low production costs and with the possibility to vary simply and cheaply said upper both as regards the colors and as regards the type of fabric used.

The methods used to provide knitted uppers entail the use of knitting machines intended to produce a rectilinear fabric, and in this case a subsequent step is provided for closure by joining the sides in the region of the sole, of the rear part and/or of the insole, or entail the use of circular machines which allow to obtain tubular elements which, in some cases, are subsequently closed at the tip and thermoset in order to obtain the suitable shape.

WO2015068108 describes, for example, a method for providing shoes by means of circular machines which entails the production of a traditional sock structure on which a sole is then applied.

WO2014096561 relates to a shoe which comprises a first enclosure, which extends longitudinally from a rear end to a front end, transversely between a lateral edge and a central margin and vertically from a base to an upper end.

In particular, the first enclosure comprises yarns which are mutually connected mechanically; at least part of said yarns comprising at least one thermosettable yarn which are distributed on all of the first enclosure so that the shape of the first enclosure is determined according to the thermosetting of the thermosettable yarn.

Typically, independently of the production method of the knitted uppers, it is necessary to provide the upper, at the region intended for fastening, with loops or holes for the passage of the laces.

Some known solutions entail providing said loops or holes by knitting, but in this case it is observed that said loops, when the lace applies stress to them, discharge the force onto the adjacent stitches, consequently producing their rupture or a certain deformation.

The aim of the present invention is to provide an upper and a method for the manufacture of an upper capable of improving the background art in one or more of the aspects indicated above.

Within this aim, an object of the invention is to devise an upper and a method for the manufacture of an upper that allow to provide engagement elements for laces which are strong and practical to use.

Another object of the invention is to provide an upper and a method for the manufacture of an upper which allow to make the shoes obtained more comfortable to wear but are also capable of obtaining a stiffened structure which can allow the effective use of the upper also for shoes subjected to considerable stresses.

Another object of the invention is to provide an upper and a method for the manufacture of an upper which are highly reliable, relatively easy to provide and at competitive costs.

This aim, as well as these and other objects which will become better apparent hereinafter, are achieved by an upper and by a method for the manufacture of an upper according to the independent claims, optionally provided with one or more of the characteristics of the dependent claims.

Further characteristics and advantages of the invention will become better apparent from the description of some preferred but not exclusive embodiments of the upper and of a method for the manufacture of an upper according to the invention, illustrated by way of non-limiting example in the accompanying drawings, wherein.

Figure 1:
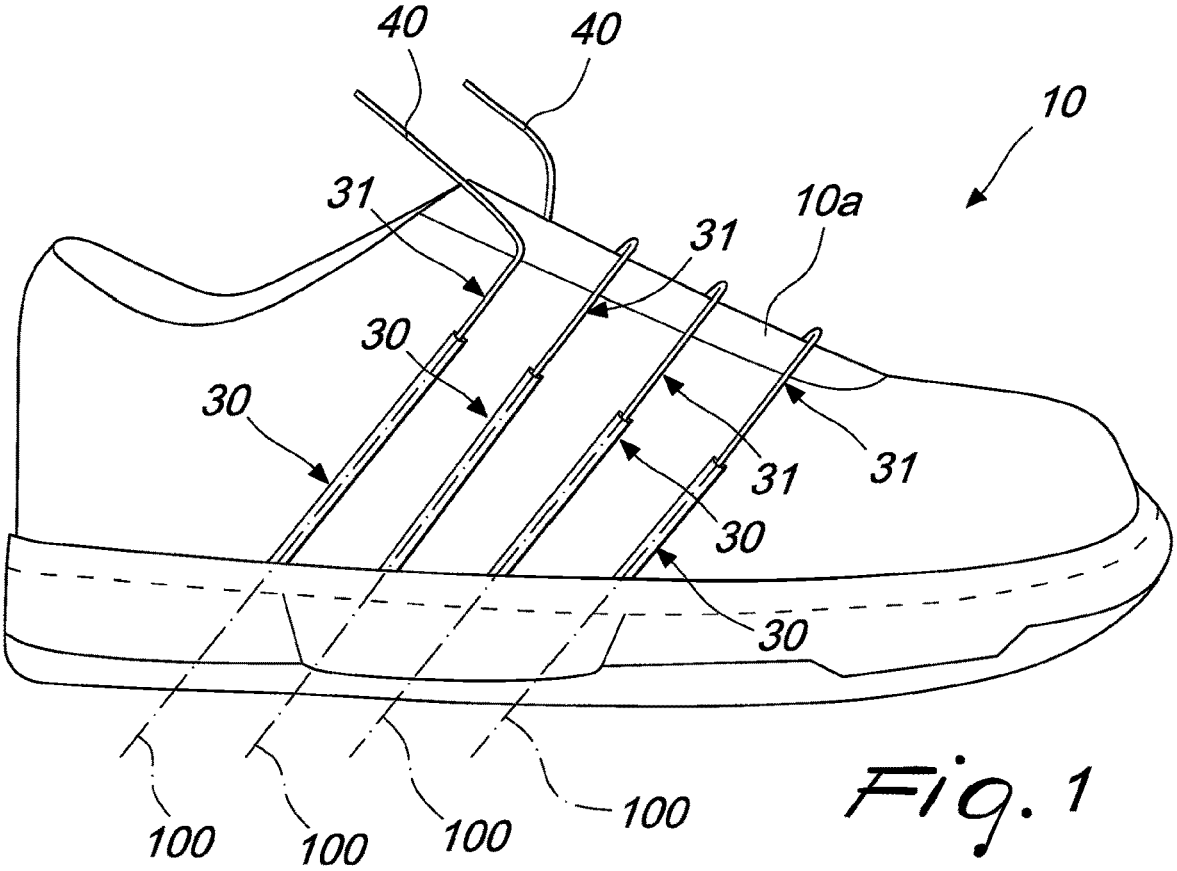
FIG. 1 is a schematic lateral elevation view of a shoe obtained with a first embodiment of a semi-finished component according to the invention.

With reference to the figures, the semi-finished component according to the invention, designated generally by the reference numeral 1, comprises a semi-finished component 1 for the production of knitted uppers 10.

The semi-finished component 1 comprises a plain knitting 21 and a purl knitting 22.

According to the present invention, the semi-finished component 1 has at least one longitudinally extended channel 30 which is formed within the knitting between the plane formed by the plain knitting 21 and the plane formed by the purl knitting 22.

Figure 4:
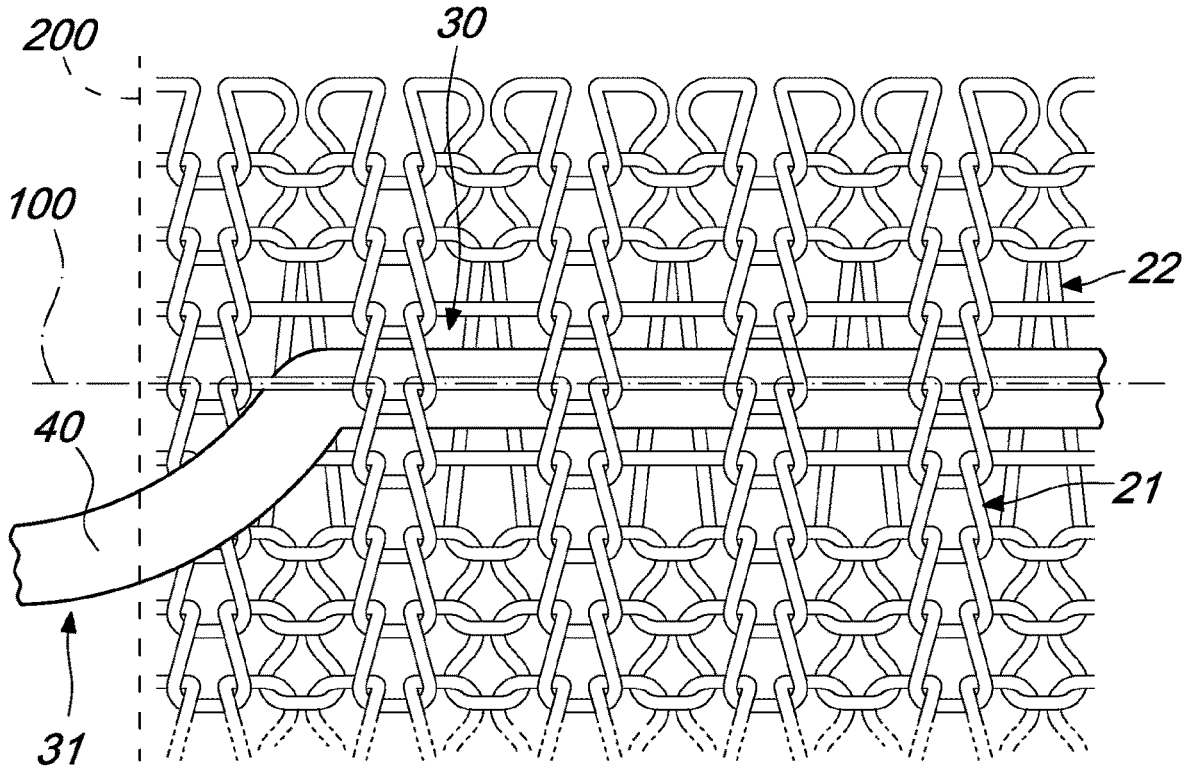
FIG. 4 is an enlarged-scale view of a portion of a semi-finished component according to the invention of a knitting which embeds a longitudinal channel engaged by a lace.
Figure 5:
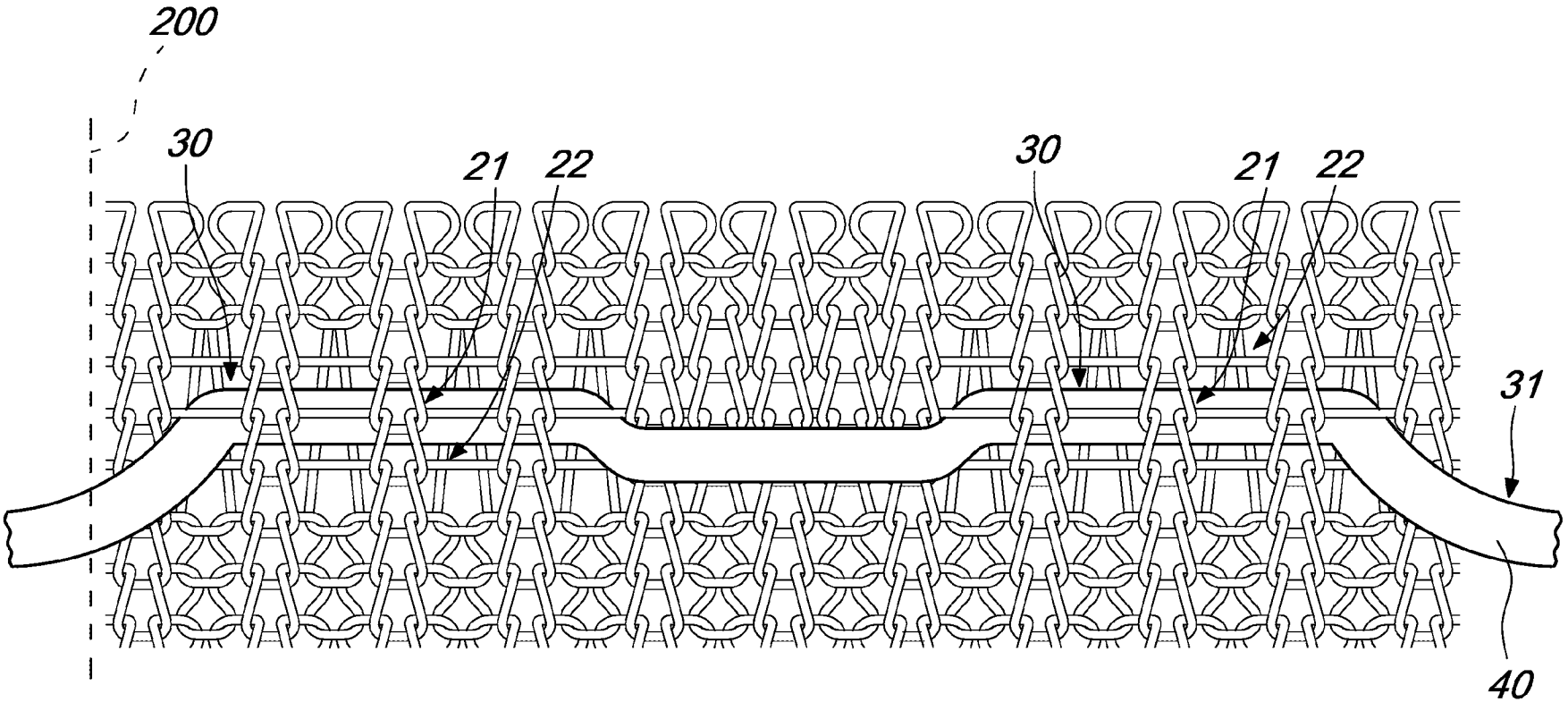
FIG. 5 is a view of a constructive variation of the portion shown in FIG. 4.

Conveniently, the direction along which the or each longitudinally extended channel 30 is extended is substantially transverse to the weaving direction of the knitting (the latter designated by the reference numeral 200 in FIGS. 4 and 5).

In practice, the longitudinally extended channels 30 are extended parallel to the rows of knitting.

Specifically, the or each longitudinally extended channel 30 can be engaged by an elongated engagement element 31 which forms a lace 40 or a reinforcement element 50 designed to engage a lace 40.

Preferably, the or each longitudinal channel 30 is extended, in the direction of extension of the rows, for at least one stitch.

In this regard, it has been observed that it is advantageous to provide that the longitudinally extended channel or channels 30 extend, in the row extension direction, for at least 3 consecutive stitches of knitting, especially if one wishes to obtain a longitudinally extended channel 30 that has good structural properties.

With reference to the knitting patterns shown in FIGS. 4 and 5, it is noted that the extension in the direction of the rows of the purl stitches, even the ones at the longitudinally extended channels 30, is constant, while the presence, again along the direction of extension of the rows, of multiple plane stitches for each respective purl stitch produces a three-dimensional extension of the respective longitudinally extended channel 30 toward the outside of the knitting, on the plain side.

However, it is also possible to provide the longitudinally extended channels 30 by providing individual stitches, which are mutually spaced along the direction that is transverse to the weaving direction and provide, between the plane formed by the plain knitting 21 and the plane formed by the purl knitting 22, a respective channel portion.

Adjacent to the longitudinally extended channels 30, both along the rows and along the columns of knitting, it is possible to provide knitting patterns of different types, for example stocking stitch knitting or flat knitting.

Conveniently, the semi-finished component 1 comprises a tubular element.

Figure 6:
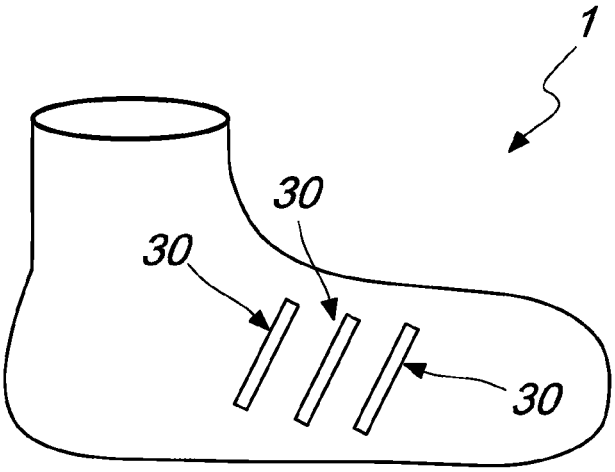
FIG. 6 is a schematic view of first example of a semi-finished component according to the invention.
Figure 7:
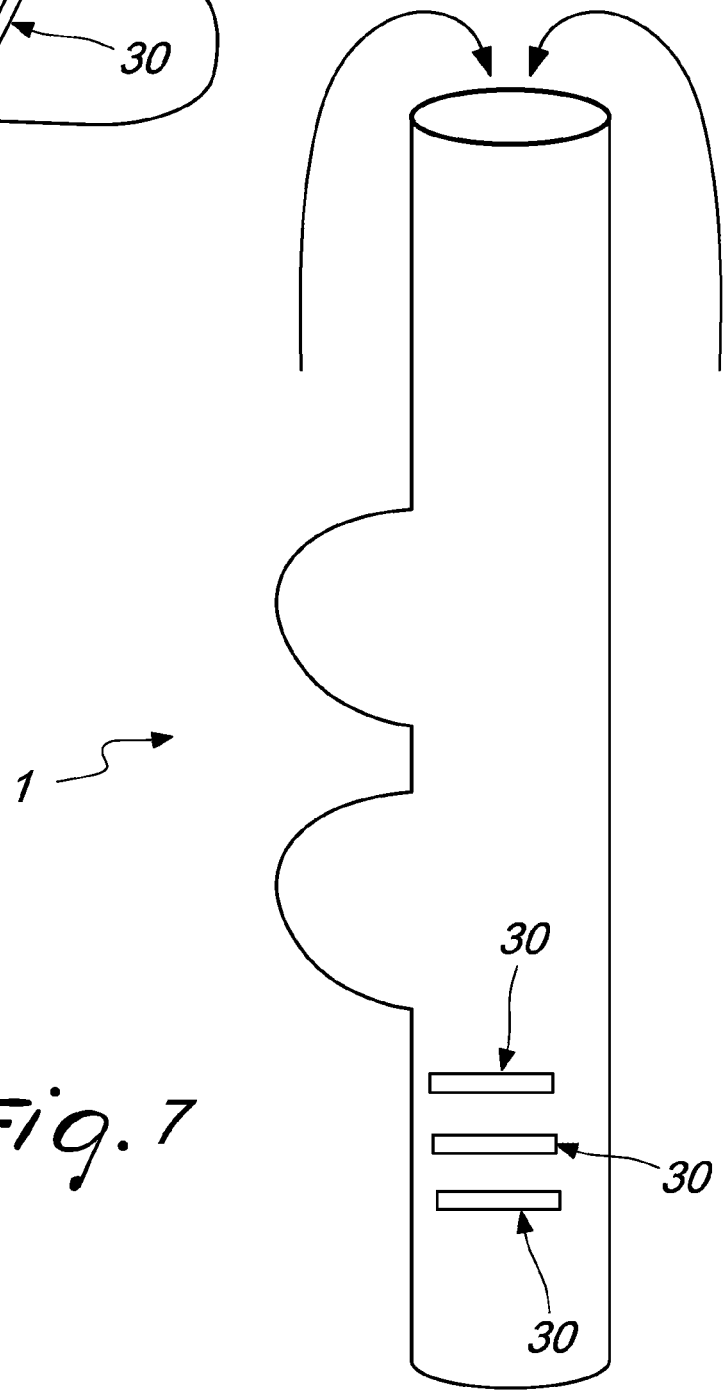
FIG. 7 is a schematic view of a second example of semi-finished component according to the invention.

The semi-finished component 1 can be the single-layer type, as shown in FIG. 6, or of the double-layer type, as shown in FIG. 7.

According to a preferred practical embodiment, the semi-finished component 1 forms a fastening region 10*a* of the upper 10.

In one possible embodiment, the semi-finished component 1 has at least one first longitudinal channel 30 and at least one second longitudinal channel 30, which are arranged on opposite sides with respect to the fastening region 10*a*.

Conveniently, the or each longitudinal channel 30 is extended along a direction of extension 100 that is substantially perpendicular to the direction of extension of the fastening region 10*a*.

Figure 2:
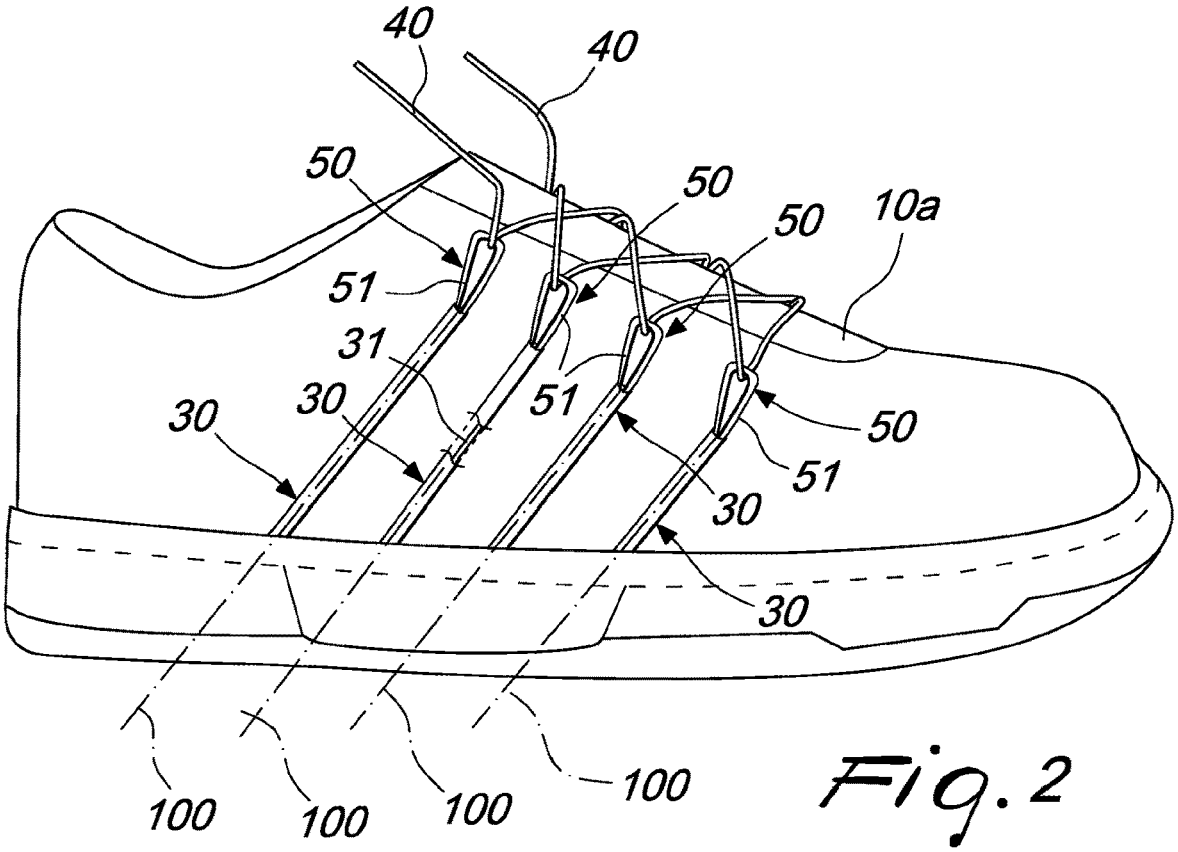
FIG. 2 is a schematic lateral elevation view of a shoe obtained with a second embodiment of a semi-finished component according to the invention.
Figure 3:
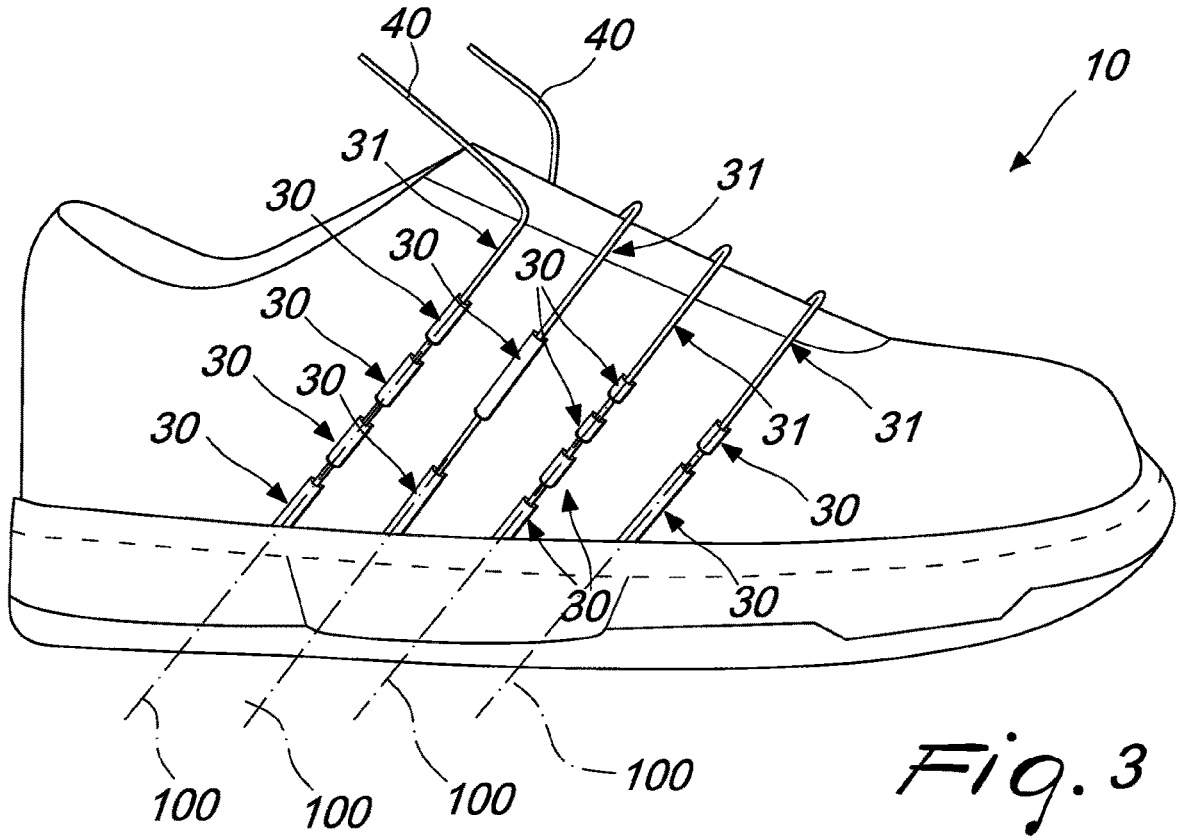
FIG. 3 is a schematic lateral elevation view of a shoe obtained with a third embodiment of a semi-finished component according to the invention.

With particular reference to the embodiment shown in FIG. 2, the reinforcement element 50 is associated with an engagement loop 51 for a lace 40.

The present invention also relates to a method for the manufacture of a semi-finished component 1 for the manufacture of knitted uppers 10.

The method comprises a step of providing a semi-finished component 1 which has a plain knitting 21 and a purl knitting 22.

The step of providing the semi-finished component 1 according to the present invention, comprises a step of providing at least one longitudinal channel 30 which is formed within the knitting between the plane formed by the plain knitting 21 and the plane formed by the purl knitting 22.

Conveniently, the longitudinally extended channels 30 are extended parallel to the rows of knitting.

In practice, the step of providing at least one longitudinal channel 30 provides for a step of retention of the purl knitting stitches on the part of the respective needles and a simultaneous provision, with the needles designed to weave the plain knitting, of a preset number of rows in order to obtain a channel that has a predetermined transverse cross-section.

Subsequently, a step of returning to knit the needles assigned to retaining the purl knitting stitches is provided, in order to continue the production of the knitting.

In practice it has been found that the invention achieves the intended aim and objects, providing a semi-finished component and a method for the manufacture of a semi-finished component for uppers with integrated engagement elements for laces which are strong and practical to use.

Furthermore, the semi-finished component 1 obtained according to the invention allows to provide uppers for shoes which, while maintaining the typical comfort of uppers provided by knitting, have a greater structural rigidity, by virtue of the presence of the longitudinal channels 30, said rigidity allowing their effective use even in sectors such as sport shoes or for so-called trail running.

The invention thus conceived is susceptible of numerous modifications and variations, all of which are within the scope of the appended claims; all the details may furthermore be replaced with other technically equivalent elements.

Thus, for example, if a rectilinear machine is used, the longitudinally extended channel or channels 30 can be provided between the plain and purl planes provided respectively by the first and second needle bed.

In practice, the materials used, so long as they are compatible with the specific use, as well as the contingent shapes and dimensions, may be any according to the requirements and the state of the art.

The disclosures in Italian Patent Application No. 102019000007821 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A semi-finished component for the manufacture of knitted uppers, comprising a plain knitting and a purl knitting, and at least one longitudinal channel which is formed within said knitting between a plane formed by said plain knitting and a plane formed by said purl knitting, said at least one longitudinally extended channel being configured to be engageable by an elongated engagement element which forms a lace or a reinforcement element designed to engage with a lace, wherein at the longitudinally extended channel an extension in a direction of rows of the purl knitting is constant and an extension in a direction of rows of the plain knitting comprises multiple plain stitches for each respective purl stitch so as to produce a three-dimensional extension of the longitudinally extended channel in a direction toward an outside of the knitting.

2. The semi-finished component according to claim 1, wherein said at least one longitudinal channel is extended along at least one stitch of knitting.

3. The semi-finished component according to claim 1, wherein said at least one longitudinally extended channel is extended substantially parallel to the rows of the knitting.

4. The semi-finished component according to claim 1, wherein the semi-finished component is in a form of a tubular element.

5. The semi-finished component according to claim 1, wherein said semi-finished component forms a fastening region of the knitted upper, said semi-finished component having at least one first longitudinal channel and at least one second channel arranged on opposite sides with respect to said fastening region.

6. The semi-finished component according to claim 5, wherein said at least one first longitudinal channel is extended along a direction of extension that is substantially perpendicular to the direction of extension of said fastening region.

7. The semi-finished component according to claim 1, wherein said reinforcement element is associated with an engagement loop for a lace.

8. A method for the production of a semi-finished component for the production of knitted uppers, comprising a step of providing a semi-finished component which has a plain knitting and a purl knitting, and a step for providing at least one longitudinal channel formed inside the knitting between the plane formed by said plain knitting and the plane formed by said purl knitting, the longitudinal channel being configured to be engageable by an elongated engagement element which forms a lace or a reinforcement element configured to engage with a lace, wherein at the longitudinal channel an extension in a direction of rows of the purl knitting is constant and an extension in a direction of rows of the plain knitting comprises multiple plain stitches for each respective purl stitch so as to produce a three-dimensional extension of the longitudinal channel in a direction toward an outside of the knitting.

9. The method according to claim 8, wherein said step of providing at least one longitudinal channel comprises a step of retention of purl stitches by the respective needles and a simultaneous provision, with the needles intended for knitting the plain knitting, of a predefined number of rows, in order to obtain at least one longitudinally extended channel which has a predetermined transverse cross-section.

10. The method according to claim 9, further comprising a step of returning to knit the needles intended to retain the purl stitches in order to continue the production of knitting.

* * * * *